US005785495A

United States Patent [19]

Springer et al.

[11] Patent Number: 5,785,495

[45] Date of Patent: Jul. 28, 1998

[54] FIBER-REPELLANT CENTRIFUGAL PUMP

[75] Inventors: Peer Springer, Neuhofen; Roland Wellmeier, Bobenheim Roxheim, both of Germany

[73] Assignee: KSB Aktiengesellschaft, Frankenthal, Germany

[21] Appl. No.: 624,694

[22] Filed: Mar. 25, 1996

[30] Foreign Application Priority Data

Mar. 24, 1995 [DE] Germany ..... 195 10 811.6

[51] Int. Cl.[6] ..... F04D 29/34

[52] U.S. Cl. ..... 415/221; 415/211.2; 415/914

[58] Field of Search ..... 415/182.1, 914, 415/191, 208.1, 211.2, 221

[56] References Cited

U.S. PATENT DOCUMENTS

| | | | |
|---|---|---|---|
| 3,168,048 | 2/1965 | Toyokura et al. | 415/221 |
| 5,137,419 | 8/1992 | Waterman | 415/914 |
| 5,230,605 | 7/1993 | Yamaguchi et al. | 415/914 |
| 5,397,215 | 3/1995 | Spear et al. | 415/914 |

FOREIGN PATENT DOCUMENTS

| | | | |
|---|---|---|---|
| 562851 | 9/1958 | Canada | 415/914 |
| 0 512 190 A1 | 5/1991 | European Pat. Off. . | |
| 0 475 920 A1 | 8/1991 | European Pat. Off. . | |
| 2279954 | 7/1975 | France . | |
| 501662 | 7/1930 | Germany . | |
| 25 30 214 A1 | 7/1975 | Germany . | |
| 43 14 577 A1 | 5/1993 | Germany . | |
| 619722 | 3/1949 | United Kingdom | 415/914 |
| 877976 | 9/1961 | United Kingdom | 415/914 |

*Primary Examiner*—John T. Kwon
*Attorney, Agent, or Firm*—Darby & Darby

[57] ABSTRACT

A centrifugal pump having a housing which includes an impeller mounted in the housing. At least one guide vane is mounted between a hub and the housing and in-line with the impeller. The guide vane has a leading guide. A recess is provided in proximity to the leading edge of the guide vane providing a connection between the spaces located on both sides of guide vane to prevent clogging of the impeller by fibrous components flowing in pump medium.

8 Claims, 6 Drawing Sheets

FIBER-REPELLANT CENTRIFUGAL PUMP

BACKGROUND OF THE INVENTION

1. Field of the Invention

The present invention relates to centrifugal pumps adapted to prevent clogging of its guide wheel or impeller. More particularly, the present invention relates to a centrifugal pump having a fiber-repellant wall.

2. Discussion of the Related Art

Impeller-equipped centrifugal pumps predominantly having an axial flow direction are more common than centrifugal pumps having a semi-axial flow direction. Centrifugal pumps having a semi-axial flow direction are susceptible to problems caused by foreign particles present in the pump medium, and in particular those which are fibrous in nature. German Patent No. 501 662 describes an early attempt at solving this problem. Inserts or grooves in the pump housing were provided to form edges intended to discard fibrous components off the ends of the impeller blades.

Regarding accumulation of fibrous material on the idle guide vanes of a centrifugal pump, French Patent FRA 2 279 954 suggests a solution requiring a special pump architecture. In this architecture, a hub supporting the impeller shaft is passed through an intake bend on the intake side. Guide vanes following the impeller are configured as free-standing fins attached at one end. The leading edge of these follower fins extends at an angle in the direction of flow such that any fibers caught in the follower fins are flushed into the clear cross-sectional center of the flow and can exit unimpeded.

However, for regular pump designs (in which the impeller shaft is bearing-mounted in a hub behind the impeller), a different solution is required. One such solution is disclosed in European Patent EPA 0 512 190 wherein a hub housing is supported by guide fins whose leading guide-wheel edge has been filed down. Thus, any fibers that might attach themselves will move toward the outer part of the blades. These leading guide-wheel edges are preceded by free-standing fins. With the aid of these free-standing fins, any fibrous components in the pumping medium are trapped before they reach the guide vanes so as to slide along the vanes toward the inside and fall off the fins near the hub. These types of blades, employing the above-described arrangement taught in French Patent FRA 2 279 954 constitutes an additional cross-sectional blockage of the guide-vane space which in the event of unfavorable operating conditions due to vibration stress, may cause a free-standing fin to break. Additionally, they provide only partial protection against clogging since the guide vanes may continue to collect fibers.

Therefore, it is an object of the present invention to overcome the shortcomings of the prior art centrifugal pumps and provide an improved centrifugal pump which when exposed to a pumping medium containing fibrous components, prevents a clogging of the guide wheel or impeller.

SUMMARY OF THE INVENTION

The present invention provides a centrifugal pump having a recess in at least one of the pump housing and hub. This recess causes the fibers to accumulate on and slide along an inclined guide vane edge so to glide over an exposed part of a blade and thus into the recess. Above the leading edge of the guide vane, the cross-sectional enlargement produced by the recess causes a local turbulence, the effect of which lifts the fibrous components off of the leading edge. With the aid of these turbulences, the fibers in the recess are held in suspension. The adjoining flow through the impeller channel in the area of the wall surfaces of the vanes then has the effect of drawing the fibers from the recess as well as creating a local return flow in the pump housing. This local return flow assures that the dynamic pressure which usually acts on the fibers in the area of the transition from the impeller to the housing between the guide vane and the housing is canceled.

The recess in the pump housing may be further configured so as to permit easy removal of fibers which slide along the leading edges of the guide vane and past the exposed edge of the guide vane and into the cavity of the recess wherein they are displaced into the space between two guide vanes. This effect is augmented by beveling the edges of the recess on the intake side of the flow space of the guide vane opposite the housing. As a result, no dead water is created at this point and the removal effect is enhanced. The elongated shape of the recess and the slope of the recess in relation to the plane of rotation of the impeller causes fibers trapped in the recess to enter in an asymmetric fashion. The flow in the open path of the channel has the effect of drawing the fibers into the channel area between neighboring guide vanes.

In particular, by virtue of an asymmetric relation between the exposed leading blade edges and the associated recesses, it is possible to control the effect of the local return flow within the recess. The turbulence within the recess can be further modified by appropriate selection of the angle of inclination of the side walls defining the recess. No negative impact of the turbulence in the recess on the flow in the open guide-vane channel has been found. This is due both to the low absolute velocity in the outer region of an impeller and to the small partial proportion of the flow shared by the recess. Also, the asymmetric configuration of the recess can be used to obtain an asymmetric flow distribution in the recess itself which further improves the loosening effect on the fibrous components accumulated therein. Additionally, the recess produces a pressure-balancing effect above the impeller blade which further aids the separation of the fibers. Practical tests have proved the efficiency of the design according to the present invention while demonstrating that there are no negative effects on the performance of the system.

Different embodiments of the present invention include rounded transitions in the area between the guide vane, the recess and/or the surface of the housing wall so as to avoid the formation of sharp edges or corners and thus prevent fibrous components from attaching themselves thereto. Further, in the region between the blades and the sidewalls of the housing, the transitions are gradual, and corresponding transitions exist in the area between the recess and the guide vane.

BRIEF DESCRIPTION OF THE DRAWINGS

The above and still further objects, features and advantages of the present invention will become apparent upon consideration of the following detailed description of a specific embodiment thereof, especially taken in conjunction with the accompanying drawings wherein.

DETAILED DESCRIPTION OF THE PREFERRED EMBODIMENTS

Figure 1:
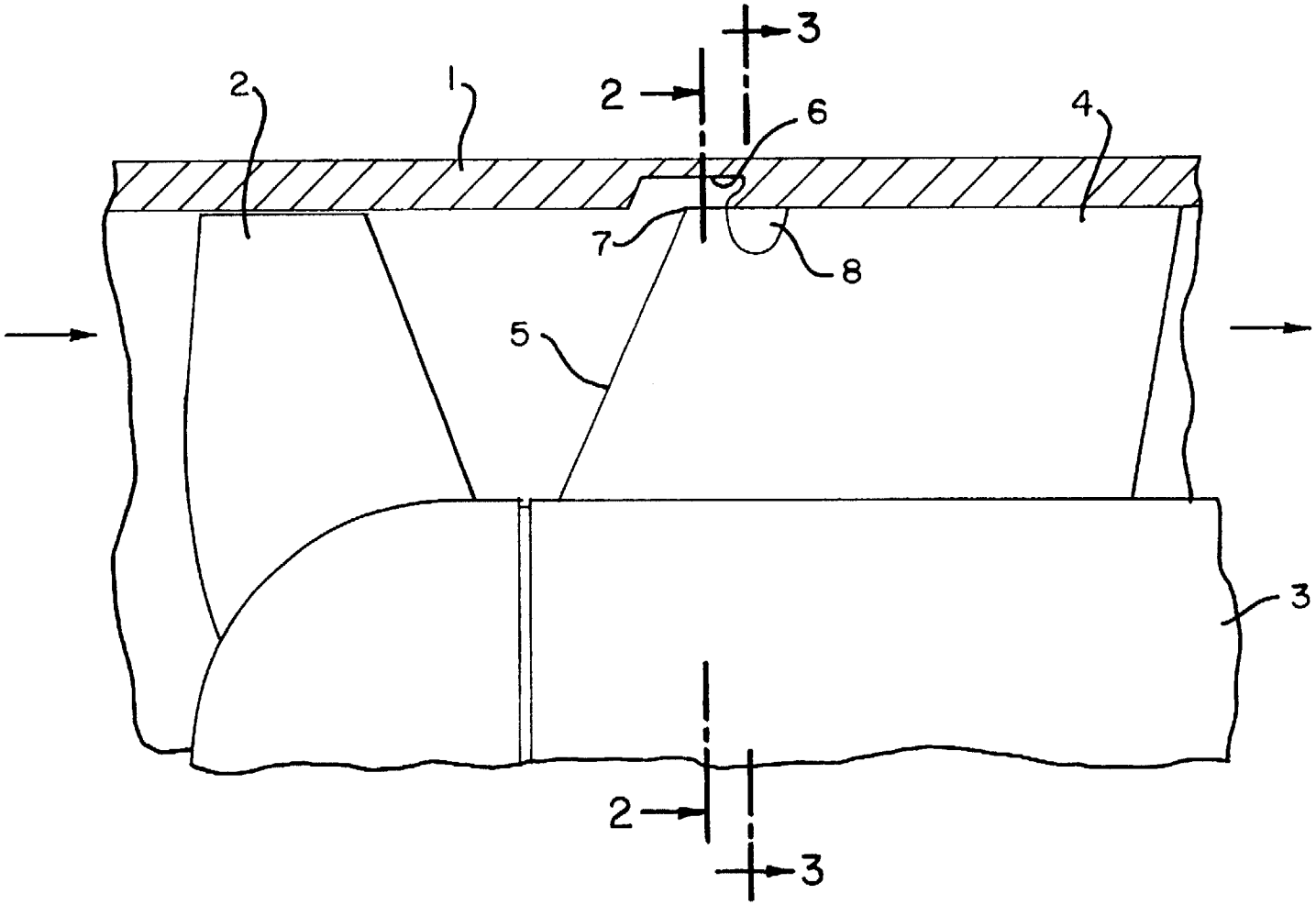
FIG. 1 is a partial cross-sectional view of a centrifugal pump housing in accordance with the present invention.

Referring now to the drawings, in which like reference numerals identify similar or identical elements, FIG. 1 illustrates a centrifugal pump having housing 1 which includes a rotating runner configured as an impeller 2 wherein the flow through the pump occurs in the axial direction relative to the pump housing axis, as indicated by the arrow. However, it is to be appreciated that the present invention is not to be limited to employment in a centrifugal pump system having an axial flow direction but rather may be employed in a centrifugal pump system having a semi-axial flow direction.

As illustrated in FIG. 1, impeller 2 is bearing-mounted in a hub 3. Hub 3 is positioned within the housing 1, via, preferably fixed, guide vanes 4. The leading edges 5 of the guide vanes 4 are preferably flared back (inclined from hub 3 in the direction of the flow). A recess 6 is formed in housing 1 such that a portion 7 of each guide vane 4 overhangs recess 6. In other words, portion 7 of guide vane 4 protrudes over or covers recess 6.

Figure 6:
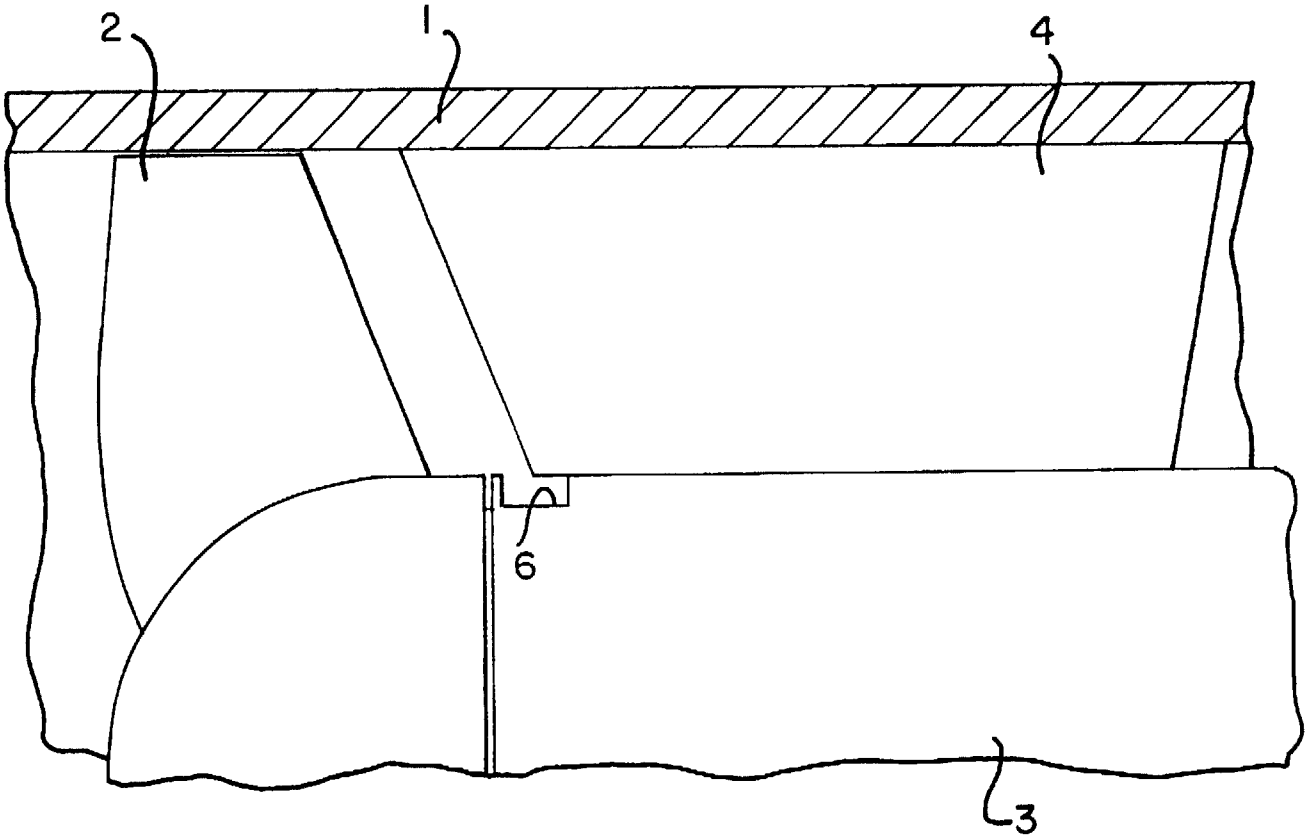
FIG. 6 is a partial cross-sectional view of a centrifugal pump housing in accordance with the present invention.

Due to the force of the pump medium flow which occurs in pump housing 1, the inclination of the leading edges of impeller 2 causes fibrous components disposed in the pump medium flow to glide along the leading edges 5 of the guide vanes 4 and, via the overhanging impeller inlet edge 7, into the recess 6. It is to be appreciated that, depending on the flow pattern caused by impeller 2, the inclination of the leading impeller edges 5 may differ in configuration and direction from that shown in FIG. 1. For example, if the leading impeller edges 5 have a forward sweep, (as opposed to the backward sweep of FIG. 1) the pump medium fibers would be directed toward hub 3, in which case the recess would be formed in hub 3 (see FIG. 6).

It is noted that the provision of recess 6 in pump housing 1 creates a "Dead Water" condition in which recess 6 creates a return pump medium flow in pump housing 1 which causes turbulences such that pump medium fibers are suspended in recess 6. A bulged transition formation 8 is provided on each guide vane 4 in the region behind recess 6 (relative the to the direction of pump medium flow). A second bulged transition formation 9 is provided on each housing wall 1. The bulged transition formations 8, 9 prevent sharp-edged transitions in the region between each guide vane 4 and housing 1. Under unfavorable circumstances, sharp-edged transitions in the region between guide vane 4 and housing 1 often creates a buildup and jamming of pump medium fiber component in this region.

Figure 2:
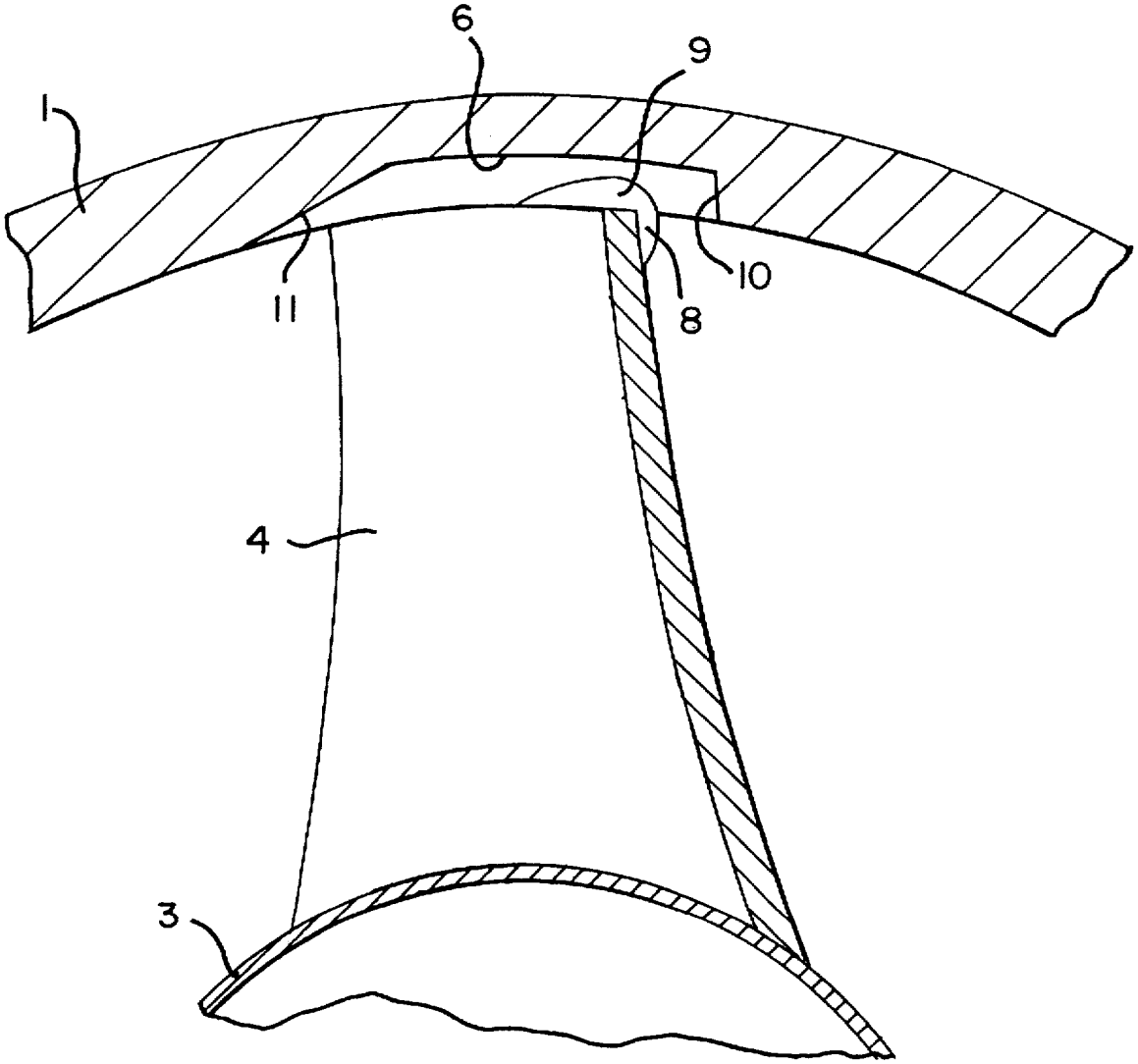
FIG. 2 is a cross-sectional view taken along line A—A of FIG. 1 and looking in the direction of the arrows.

Referring now to FIG. 2, the position of a recess 6 relative to a guide vane 4 is illustrated. It thus can be seen that pump medium fiber components which contact leading edge of the impeller blades 2 are displaced into recess 6 which, in the present illustrated embodiment, extends to below the plane of the diagram. As mentioned above, the bulged-like transitions 8,9 between the guide vane 4 and the housing 1 prevent the formation of sharp edges in the region between the guide vane 4, the housing 1 and the recess 6. In relation to the side wall 10 of recess 6, transition 9 is preferably shaped in a ledge configuration wherein sidewall 10 is formed at an angle relative to the perpendicular axis of the circumference of pump housing 1. Further, opposing sidewall 11 of recess 6 is sloped at a greater angle relative to side wall 10. The respective angles of inclination of side walls 10 and 11 enable control of pump medium turbulence within recess 6 permitting a separating effect on pump medium fibers which have accumulated in recess 6.

Figure 3:
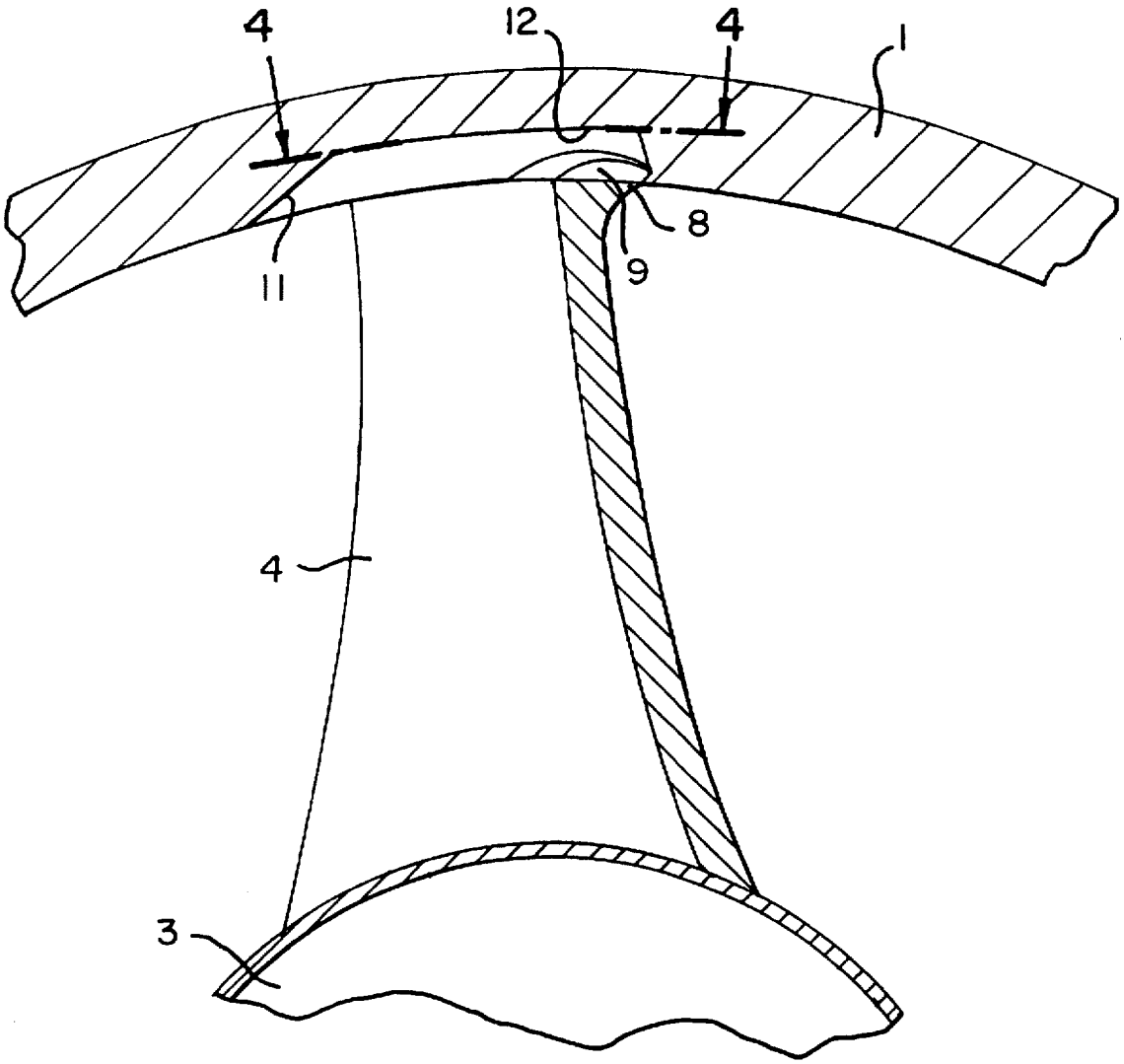
FIG. 3 is a cross-sectional view taken along line B—B of FIG. 1 and looking in the direction of the arrows.

Referring now to FIG. 3, the inclination of the sidewalls 11 of recess 6 is illustrated. This inclination corresponds to the direction of pump medium flow which permits a good measure of control in the removal of fibrous components from recess 6. Therefore, return-flow turbulences formed by recess 6 can exercise a lifting action on the fibrous components in recess 6 thus providing efficient pump operation.

Figure 4:
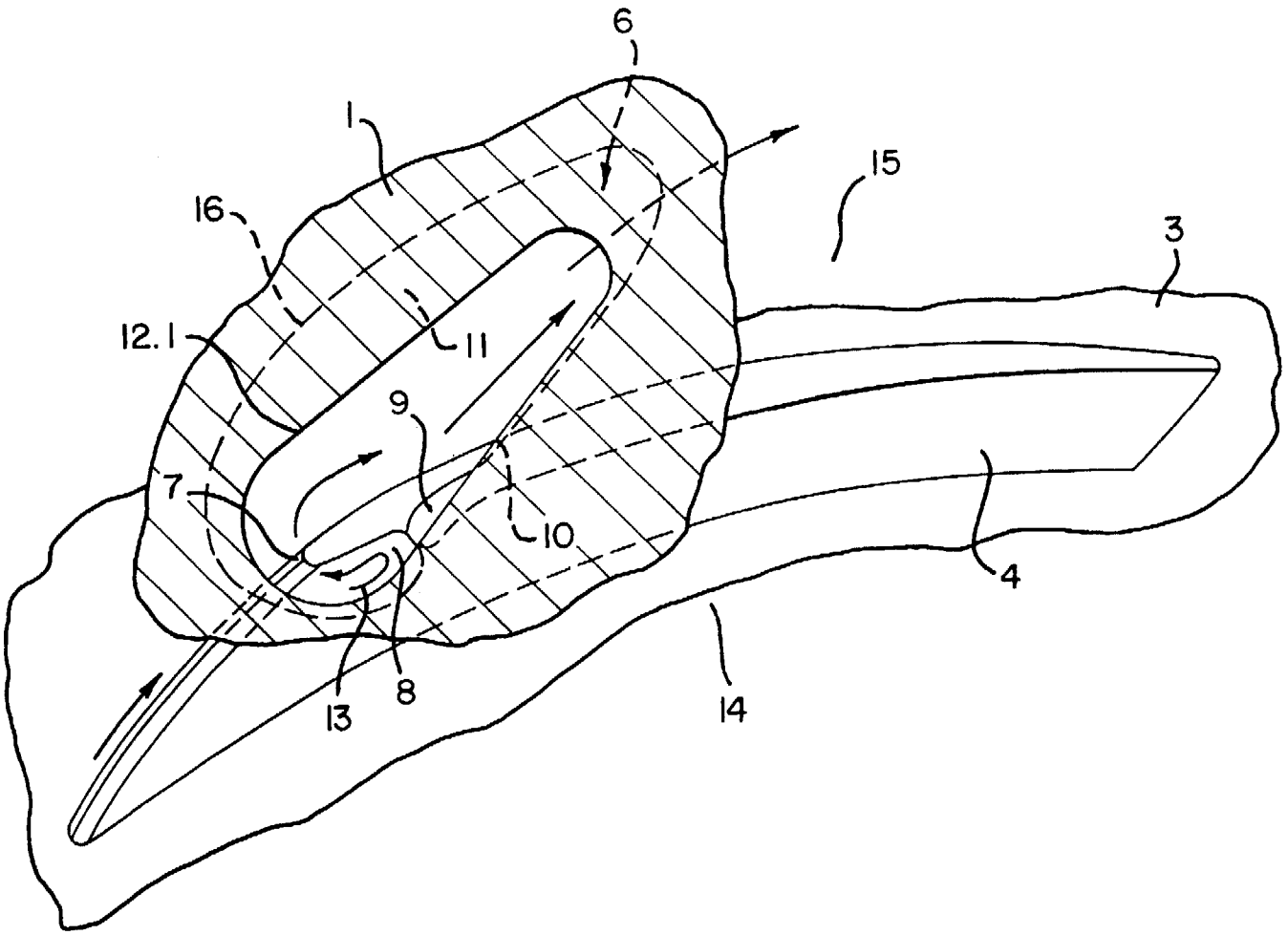
FIG. 4 is a cross-sectional view taken along line C—C of FIG. 3 and looking in the direction of the arrows.

FIG. 4 illustrates a portion of the impeller corresponding to the cross-sectional view taken along line C—C of FIG. 3. In particular, a top view of guide vane 4 is illustrated in conjunction with recess 6. It is noted that this view is depicted to permit viewing through recess 6 toward a respective guide vane 4. Pump housing 1 and hub 3 are shown as cutout views only. The arrows of FIG. 4 are indicative of the direction of flow of the pump medium on both sides of the guide vane 4, in the region above impeller inlet edge 7, at the region surrounding bulges 8,9 and in the area of the recess 6. Inside recess 6 there is an overflow from the downstream side to the intake side of guide vane 4. In the region of bulges 8,9 a "Dead-Water" condition 13 is formed in which pump medium fibrous components are prevented from being pressed down into recess 6. It is noted that if pump medium fibers were to slide into the recess 6, their ends would protrude into the open cross-sectional path of the guide channels 14, 15 downstream of recess 6. Thus, in the absence of any downward pressure in the recess 6, the pump medium fibrous components are picked up by the flowing pumping medium, effectively transferred to one side of guide vane 4 (e.g., side 15) and consequently carried away.

With continued reference to FIG. 4, the elongated configuration of recess 6 in which its position relative to guide vane 4 is asymmetric, enables the removal action of the pumping medium on the fibrous components. The line 16 which corresponds to the opening of recess 6 in the wall surface of the housing 1, and the line 12.1 which represents the bottom surface 12 of recess 6, indicate the slope of wall surfaces 10, 11 of the recess 6. Similar to the contour lines of a map, the lines in this embodiment illustrate the inclination of wall surfaces 10 and 11. The approximate vertical angle of the wall surface 10 in the vicinity of the guide vane 4 enhances the localization of return-flow turbulences in that region which causes the fibers to attach themselves. In the opposite area along wall surface 11, the steeper slope of recess 6 reduces the purging effect on the ends of the fibrous components, thus aiding the flow of the medium in picking up the ends of the fibers which in turn is facilitated by the lifting action of the various return-flow turbulences.

Figure 5:
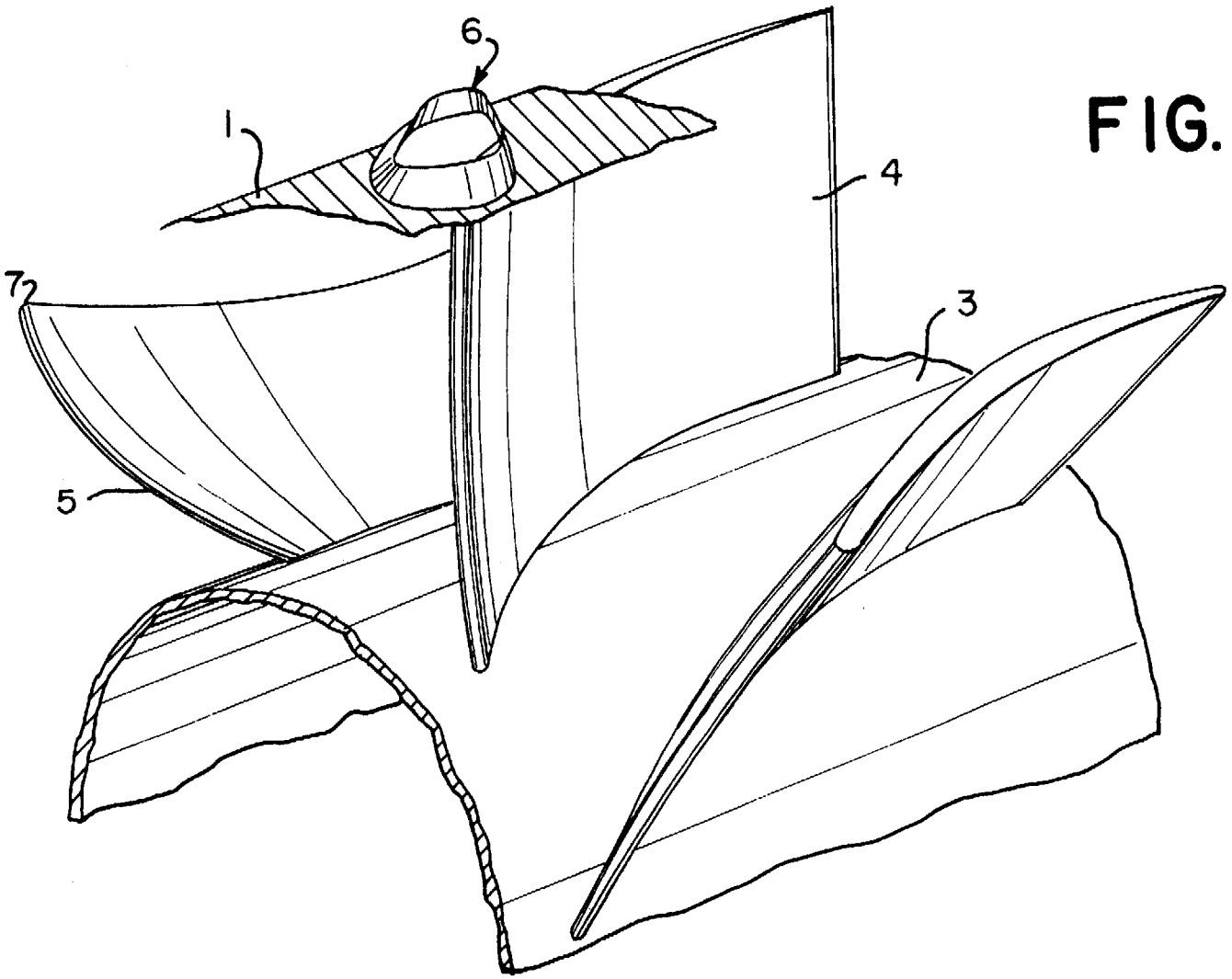
FIG. 5 is a spatial representation of the guide vanes of FIG. 1.

Referring now to FIG. 5, a spatial, three-dimensional wire-frame representation, depicting the outline of recess 6 and its position relative to a leading guide-vane edge 5,7 is illustrated. For ease of illustration, recess 6 is shown open, analogous to the section C—C of FIG. 4. The sloping or asymmetric relation of recess 6 and guide vane 4 enhances the lifting action for the fibers in the area of recess 6. It is thus possible to optimize the hydraulic properties of the guide vanes 4 which no longer need to be provided with flow-impairing bulges or beads in the area of their leading edges 5.

Having described the presently preferred exemplary embodiments of a centrifugal pump in accordance with the present invention, it is believed that other modifications, variations and changes will be suggested to those skilled in the art in view of the teachings set forth herein. It is, therefore, to be understood that all modifications, variations and changes are believed to fall within the scope of the present invention without departing from the spirit and scope of the invention as disclosed above.

What is claimed is:

1. A centrifugal pump comprising:

a housing;

an impeller mounted in the housing;

a hub;

at least one guide vane mounted between the hub and the housing and in-line with the impeller, the at least one guide vane having a leading guide vane edge, a recess is disposed in at least one of the housing and the hub in proximity to the leading guide-vane edge such that the recess provides a fluid connection between a space located on both sides of the at least one guide vane.

2. A centrifugal pump as recited in claim 1, wherein the recess is an elongated recess.

3. A centrifugal pump as recited in claim 1, wherein the recess is formed at an angle relative to the plane of rotation of the impeller.

4. A centrifugal pump as recited in claim 1, wherein the guide vane has an exposed edge in the region in proximity to the recess.

5. A centrifugal pump as recited in claim 1, wherein the recess extends asymmetrical relative to the guide vane.

6. A centrifugal pump as recited in claim 1, wherein the recess is provided with opposing sidewalls which each are formed at different angles of inclination.

7. A centrifugal pump as recited in claim 1, wherein the recess is disposed in the housing.

8. A centrifugal pump as recited in claim 1, wherein the recess is disposed in the impeller hub.

* * * * *